US006834691B2

(12) United States Patent
Goldin

(10) Patent No.: US 6,834,691 B2
(45) Date of Patent: Dec. 28, 2004

(54) WATER BOTTLE INSERT FOR STORING WATER BOTTLES FOR A WATER BOTTLE LOADING DEVICE

(76) Inventor: Martin C. Goldin, 112 Bayou Cir., Gulfport, MS (US) 60606

( * ) Notice: Subject to any disclaimer, the term of this patent is extended or adjusted under 35 U.S.C. 154(b) by 57 days.

(21) Appl. No.: 10/444,046

(22) Filed: May 22, 2003

(65) Prior Publication Data

US 2004/0231749 A1 Nov. 25, 2004

(51) Int. Cl.[7] ..... B65B 1/04; B65B 3/00; B67C 3/00

(52) U.S. Cl. ..... 141/364; 141/363; 141/366

(58) Field of Search ..... 141/18, 129, 284, 141/311 R, 363–366; 414/738, 446; 198/408–412

(56) References Cited

U.S. PATENT DOCUMENTS 5,160,013 A * 11/1992 McDowell ..... 198/412
5,288,200 A * 2/1994 Burgers et al. ..... 414/758
5,582,503 A * 12/1996 Sandoval ..... 414/738
6,003,654 A * 12/1999 Webber et al. ..... 198/408

* cited by examiner

*Primary Examiner*—Timothy L. Maust
(74) *Attorney, Agent, or Firm*—Welsh & Katz, Ltd.

(57) ABSTRACT

An apparatus is provided for loading water bottles into a water cooler. The apparatus includes a water bottle loading system for automatically installing water bottles into the water cooler and a water bottle storage insert with an inclined ramp adapted to laterally urge a plurality of water bottles towards a loading cradle of the automatic water bottle loading system under control of gravity.

33 Claims, 9 Drawing Sheets

WATER BOTTLE INSERT FOR STORING WATER BOTTLES FOR A WATER BOTTLE LOADING DEVICE

FIELD OF THE INVENTION

The field of the invention relates to water bottle delivery, storage and retrieval systems, and more particularly to water bottle delivery, storage and retrieval systems that provide for convenient full and empty water bottle delivery and storage and provide for ease of bottle changing at a water dispenser.

BACKGROUND OF THE INVENTION

Over the past decade, there has been a significant increase in bottled water consumption. Bottled water is typically delivered to homes and businesses in multi-gallon containers that are large, heavy and cumbersome. Empty and full containers are usually stored in a variety of different places such as closets, offices, hallways, under desks or in any space that might accommodate the water bottle container. Often, water bottle storage is an afterthought that occurs out of necessity.

Water bottles are used in conjunction with water dispensers that allow individuals to obtain a select amount of water from the bottle. Such dispensers may be located in homes, businesses or elsewhere. The dispensers are typically 2.5 to 4 feet in height and require that the water bottle be lifted into position and placed on the dispenser. Considering the size and weight of a full water bottle this experience can be uncomfortable and even dangerous for the individual responsible for changing the water bottle when it is empty. Injuries can and do occur when the heavy bottle is picked up by a person and rotated so that the bottle's neck is in proper position to be placed into the water dispenser. Further, empty and full water bottles that are randomly stored in a residence or a business tend to be unsightly and sometimes act as trip hazards. As such, there exists a growing need for a convenient and safe water bottle delivery, storage and retrieval system.

In general, delivery, storage and retrieval systems of various types are known in the art. Such devices are commonly used in the paper industry for paper rolls or other industries for tubular shaped goods or storage containers. However, existing delivery, storage and retrieval systems have some inherent disadvantages. One of the disadvantages with existing systems is that they do not accommodate water bottles. Another disadvantage is that they are not adaptable for both commercial and residential settings. Prior art attempts to improve water bottle delivery, storage and retrieval system that can be used in both a commercial and residential setting have failed to provide a system that is secure, easy to use and adaptable for a variety of different water bottle configurations and storage volume requirements. The present invention overcomes these deficiencies in the prior art.

The principle object of the present invention is to provide an improved water bottle delivery, storage, and retrieval system in which a delivery person can easily and rapidly position water bottles.

Another object of the present invention is to provide a novel water bottle delivery, storage, and retrieval system that can securely and compactly store a plurality of full and empty water bottles.

Still another object of the present invention is to provide a novel water bottle delivery, storage, and retrieval system that allows a person to access full water bottles and easily replace empty water bottles at a water dispenser.

A further object of the present invention is to provide a water bottle delivery, storage, and retrieval system that incorporates a convenient empty water bottle storage area.

A further object of the present invention is to provide a novel water bottle delivery, storage, retrieval and installation system which is simple in design and inexpensive to construct, and is durable and rugged in structure.

Still further objects and advantages will become apparent from a consideration of the ensuing description and drawings of the invention.

These and other objects are achieved by a water bottle delivery, storage, and retrieval system of the present invention.

SUMMARY OF THE INVENTION

An apparatus is provided for loading water bottles into a water cooler. The apparatus includes a water bottle loading system disposed above the water cooler for automatically installing water bottles into the water cooler and a water bottle storage insert with an inclined ramp adapted to laterally urge a plurality of water bottles towards a loading cradle of the automatic water bottle loading system under control of gravity.

DETAILED DESCRIPTION OF THE DRAWINGS

Figure 2:
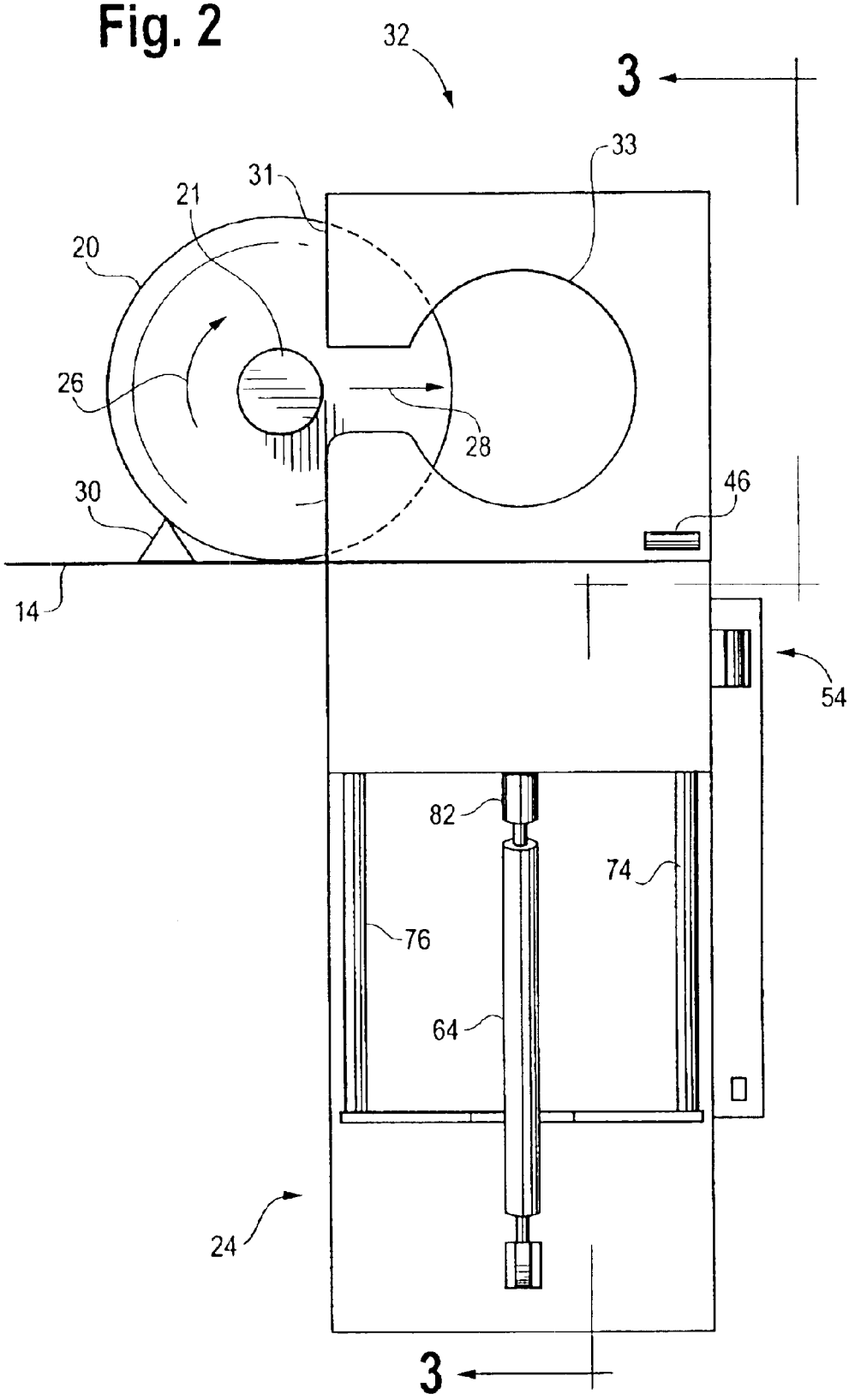
FIG. 2 depicts a water bottle handling system that may be used by the system of FIG. 1.
Figure 9A:
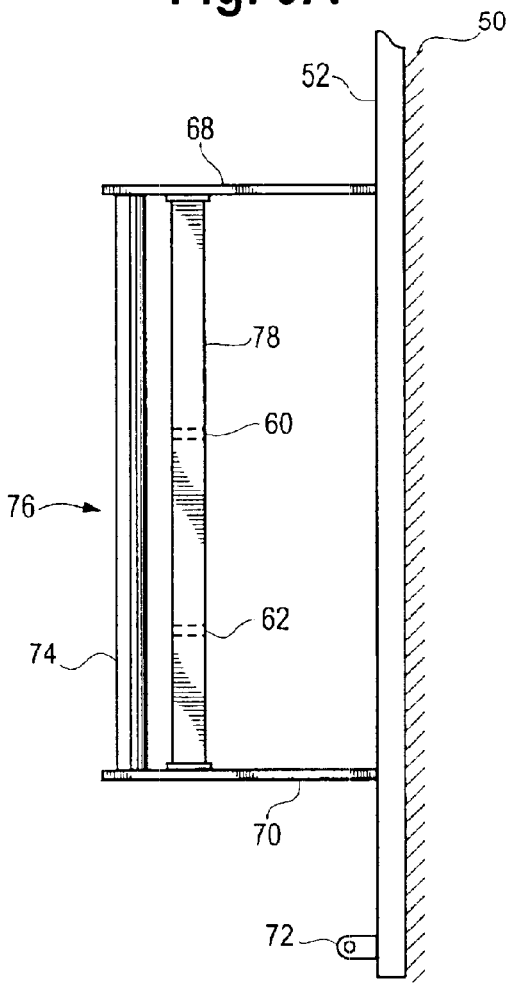
Figure 9B:
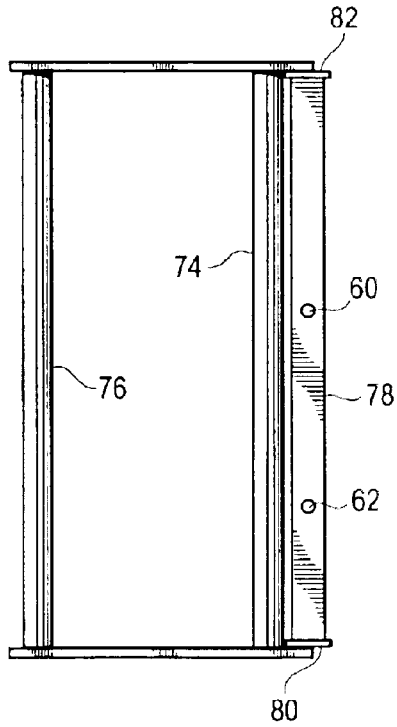
Figure 10:
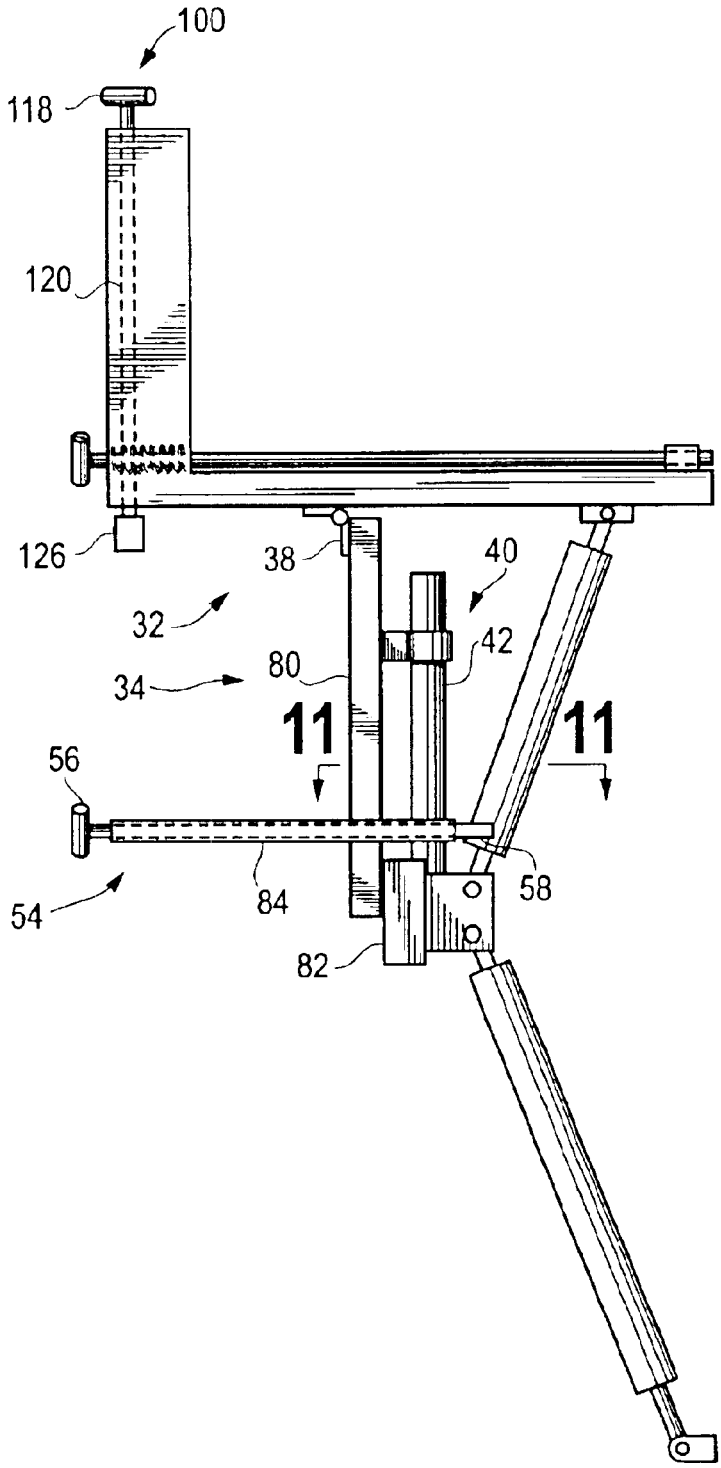
Figure 11:
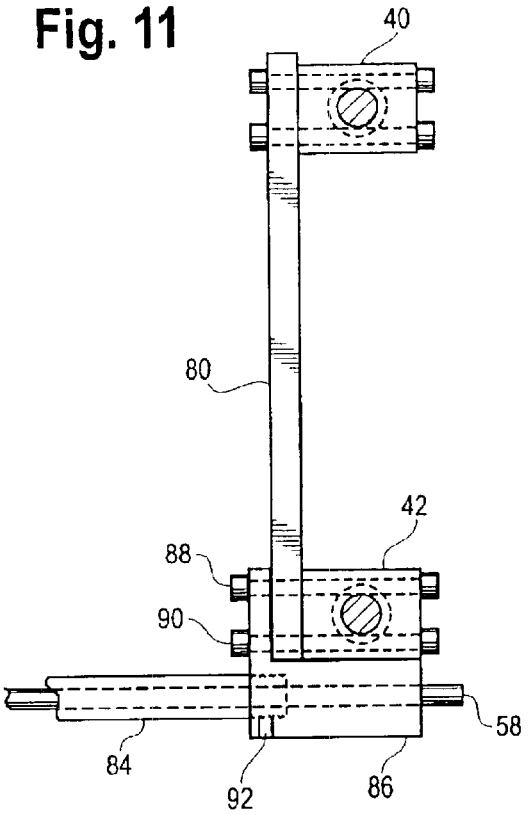
Figure 12:
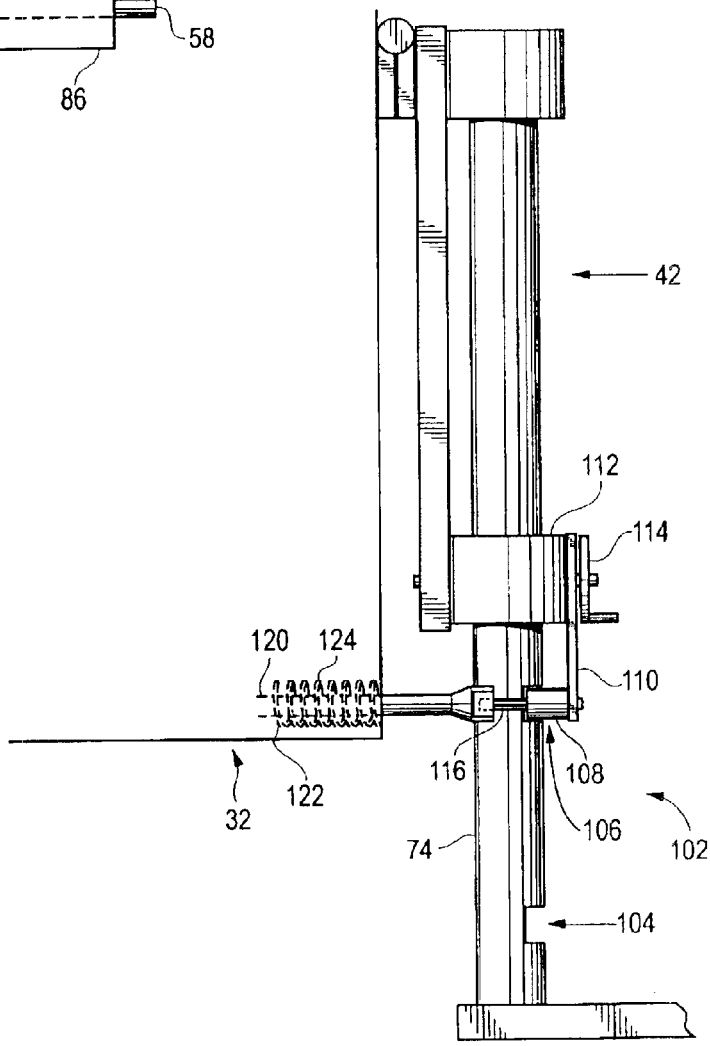

FIGS. 9*a–b* depicts side and front view of a track system of the handling system of FIG. 2;

FIG. 10 depicts a side view of a cradle assembly and elevator assembly that may be used with the system of FIG. 2;

FIG. 11 is a cut-away top view of assembly details of an elevator locking assembly that may be used by the system of FIG. 2; and FIG. 12 is a cut-away side view of assembly details of an elevator locking assembly that may be used with the system of FIG. 2 under an alternate embodiment.

BRIEF DESCRIPTION OF AN ILLUSTRATED EMBODIMENT

Figure 1:
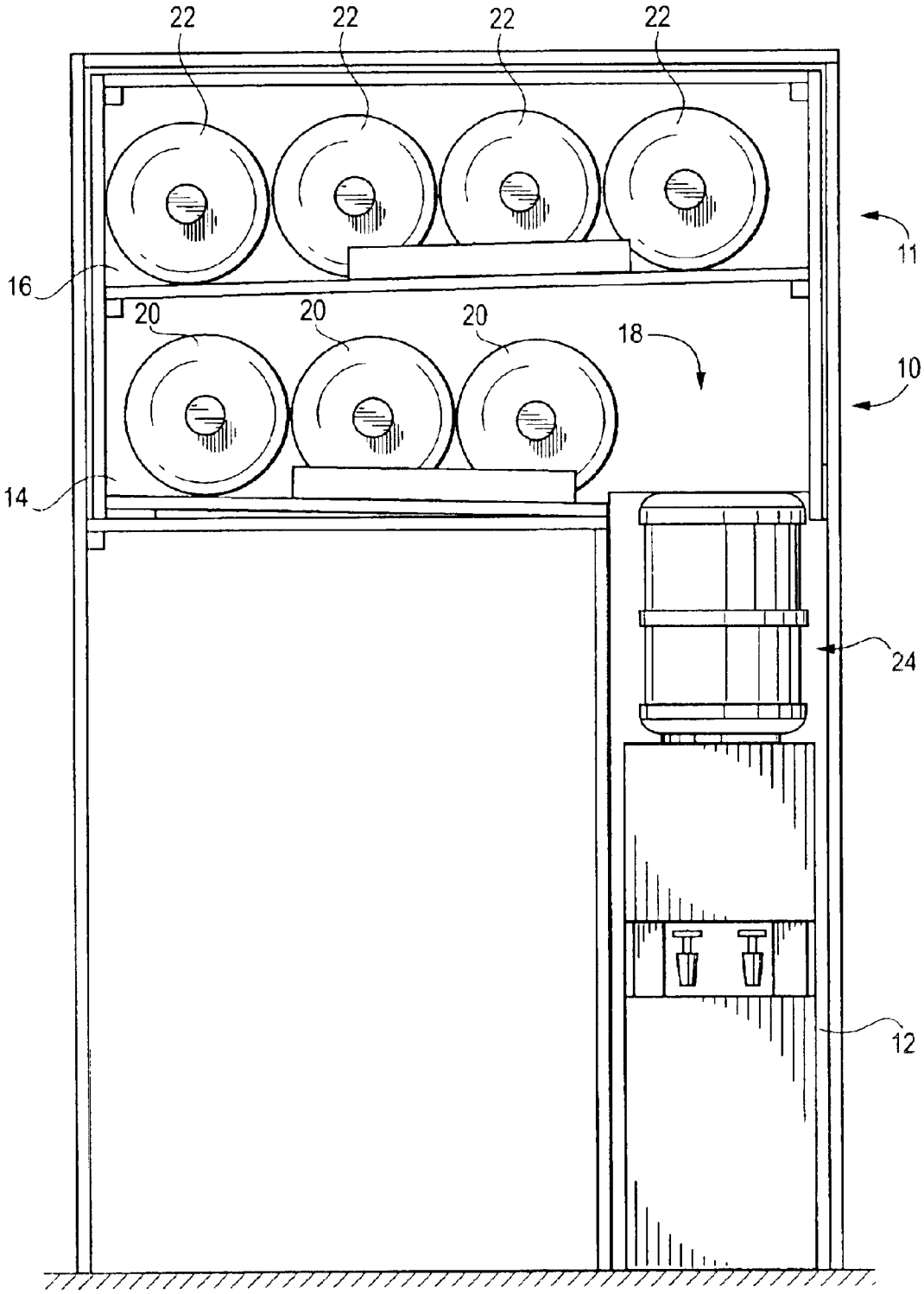
FIG. 1 depicts a system storing and installing water bottles into a water cooler in accordance with an illustrated embodiment of the invention.

FIG. 1 is a front view of a water bottle handling system 10 for storing and for installing water bottles into a water cooler 12, shown generally in accordance with an illustrated embodiment of the invention. Included within the system 10 may be a water bottle storage insert 11 for storing water bottles and a water bottle installation (loading) system 24 for installing water bottles into the water cooler 12. As used herein, a water bottle insert is a water bottle handling and storage system for full and empty water bottles that is inserted into and is supported at its intended location of use by a user-supplied structure.

In general, the water bottle storage insert 11 may be provided as a subsystem that is installed (i.e., inserted) within and supported by an enclosure supplied by others. Alternately, the water bottle insert 11 may have particular advantage when inserted through an aperture in a wall between a secure and unsecured area as described in more detail below.

The water bottle insert 11 may include a first, loading shelf 14 for storing full or partially full water bottles 20 and a second shelf 16 for storing empty water bottles 22. The loading shelf 14 is provided with a gradual incline (grade) towards a water bottle installation area 18. The second shelf 16 is provided with a gradual incline away from the area 18 of water bottle installation.

Figure 3:
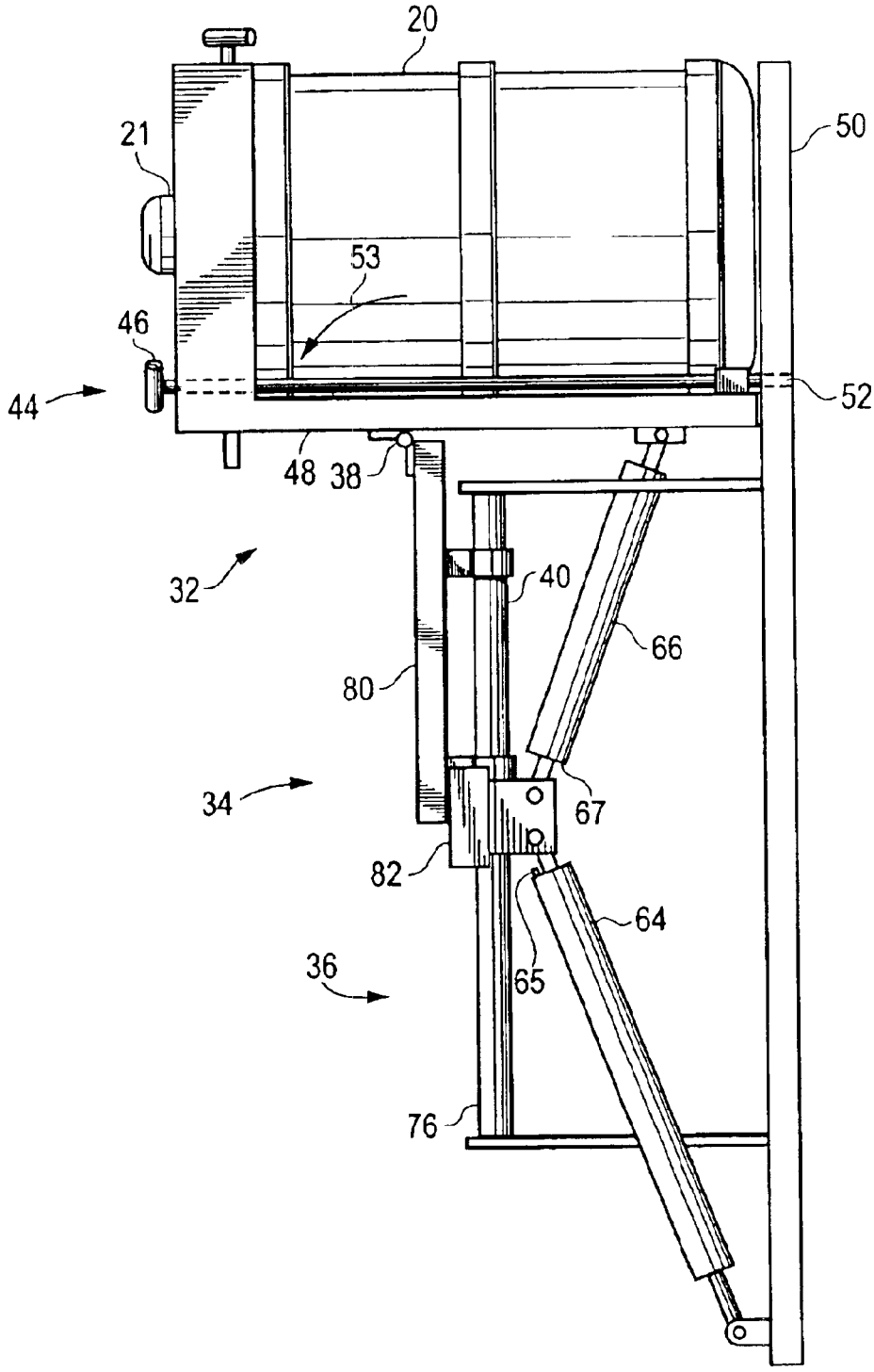
FIG. 3 depicts a cut-away side view of the system of FIG. 2.

Provided within the water bottle installation area 18 is a water bottle installation (tilting and lowering) system 24 that accepts full water bottles 20 from the shelf 14 and functions to install the water bottles 20 into the cooler 12. FIG. 2 is a front view of the water bottle installation system 24. FIG. 3 is a partial cut-away side view of the installation system 24.

In general, the bottle installation system 24 includes a tiltable cradle assembly 32 (FIG. 3) for receiving and holding the water bottles 20. The tiltable cradle assembly 32 is rotatably supported by an energy absorbing elevator assembly 34. The elevator assembly 34, in turn, is supported by a track assembly 36 that may be mounted to a vertical surface adjacent the loading shelf 14.

The tiltable cradle assembly 32 is supported in the horizontal, cantilevered position from below by a top plate of the track assembly 36 and by a hinge 38 connected to the elevator assembly 34. The hinge 38 is positioned so that the cradle assembly 32 is unbalanced to the left, as shown in FIG. 3 (i.e., slightly more than one-half of the weight of the water bottle 30 is positioned to the left of the hinge 38 shown in FIG. 2 and slight less than one-half is to the right of the hinge 38).

To prevent the cantilevered cradle 32 from tipping during loading of the water bottle 20, a cradle locking assembly 44 is provided. The cradle locking assembly 44 includes a release handle 46 and locking rod 48 that is secured to the cradle 32 and extends rearwardly to engage a locking aperture 52 within a mounting plate 50 of the water bottle installation system 24.

Figure 4:
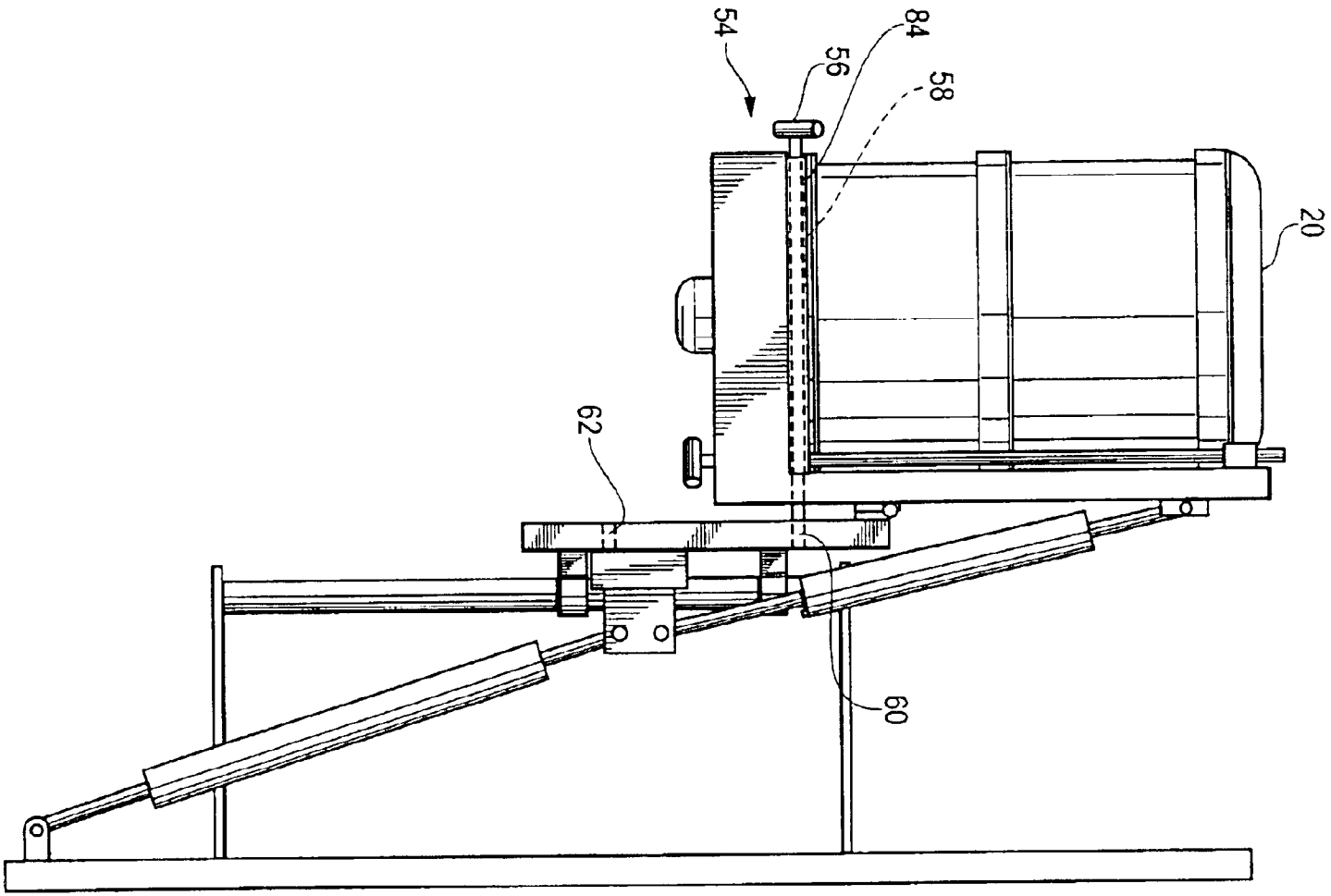
FIG. 4 depicts a side view of the system of FIG. 2 with a water bottle in an installed position.

To prevent vertical movement of the hinge 38 and elevator assembly 34, the elevator assembly 34 is provided with an elevator locking assembly 54 (FIGS. 2 and 4). The elevator locking assembly 54 may include a release handle 56 and a locking rod 58. The locking rod 58 may be adapted to engage an aperture 60 in the track assembly 36.

As generally depicted in FIG. 2, a water bottle 20 may be laterally moved 28 into the cradle 32 by rolling 26 the water bottle 20 over a bottle stop 30 on the shelf 14 into the tiltable cradle 32. An aperture 33 within a yoke 31 on an end of the cradle may be positioned so that once the bottle 20 contacts a rear wall of the cradle, a discharge end 21 of the bottle is centered within the aperture 33.

Once within the cradle 32, the release handle 46 of the cradle locking assembly may be pulled to release the cradle assembly 32. Since the cradle assembly 32 is unbalanced to the left, the cradle assembly 32 begins to rotate counterclockwise 53. To slow and control the rate of rotation, a gas-filled cylinder 66 connected between the elevator assembly 34 and cradle assembly 32 retards and resists the rotation. A gas flow control adjustment screw 67 may be provided to control a rate of extension of the cylinder 66 and, consequently, a rotation speed of the cradle assembly 32.

The cylinder 66 may simply damp the rate of rotation or may be provided with an internal spring (not shown) to return the cradle assembly 32 to a horizontal orientation. The internal spring may be sized to provide sufficient force to allow counterclockwise rotation under the weight of a full or partially full water bottle 20 and to automatically rotate clockwise when the water bottle 20 is removed from the cradle assembly 32.

During rotation, the water bottle 20 rotates from a horizontal orientation (where the water discharge end 21 is centered on a side of the bottle 20) to a vertical orientation (where the discharge end 21 of the bottle is centered on the bottom of the bottle 20) as shown in FIG. 4. As the bottle 20 is rotated, the weight of the bottle 20 is transferred from the side of the bottle to the discharge end 21. As the bottle rotates, the bottle 20 may move forward (in the direction of the discharge end 21 to more fully engage and extend through the aperture 33 in the yoke 31 of the cradle assembly 32).

Once the cradle 32 has fully rotated so that the bottle 20 is vertical, the elevator release handle 56 may be activated to release the locking rod 58 from the aperture 60. To slow the descent of the bottle 20 into the cooler 12, an elevator gas cylinder 64 may be provided to slow the vertical descent of the energy absorbing elevator assembly 34. A gas flow control adjustment screw 65 may be provided to slow a rate of contraction of the cylinder 64.

As with the cradle rotation cylinder 66, the elevator cylinder 64 may simply damp the rate of descent or may be provided with an internal spring (not shown) to return the elevator assembly 34 to a raised position. The internal spring may be sized to provide sufficient force to allow the descent of the elevator assembly 34 under the weight of a full or partially full water bottle 20 and to return the elevator assembly 34 to the raised position when the water bottle 20 is removed from the cradle assembly 32.

As the bottle 20 within the installation system 24 descends, the discharge end 21 enters a receptacle within the water cooler 12. As the water bottle 20 becomes seated within the receptacle, the locking rod 58 of the elevator locking assembly 54 engages an aperture 62 within the track assembly 36. The engagement of the locking rod 58 with the aperture 62 secures the elevator in the lowered position for as long as any water remains within the bottle 20.

Once the water within the bottle 20 is depleted, a user (not shown) may manually remove the (now much lighter) bottle 20 from the cooler 12 and cradle 32 and transfer the bottle 20 to the shelf 16. Once the bottle 20 has been removed, the user may activate the release handle 56 to release the elevator 34.

Once the elevator 34 has been released, the gas-operated cylinder 64 may automatically urge the elevator upwards. As the elevator 34 approaches its uppermost position, the cradle cylinder 66 may assist in urging the cradle 32 from the vertical position to a horizontal position. As the cradle 32 reaches the horizontal position, the locking rod 48 engages the aperture 52. Once the elevator 34 has reached its uppermost position and the cradle locking assembly 44 has locked the cradle into its loading position, another bottle 20 may be loaded into the installation system 24 and the process may be repeated.

Turning now to the specifics of the system 10, the storage insert 11 will be discussed first. Following an explanation of the operation of the storage insert 11, the loading system 24 will be discussed.

Figure 5:
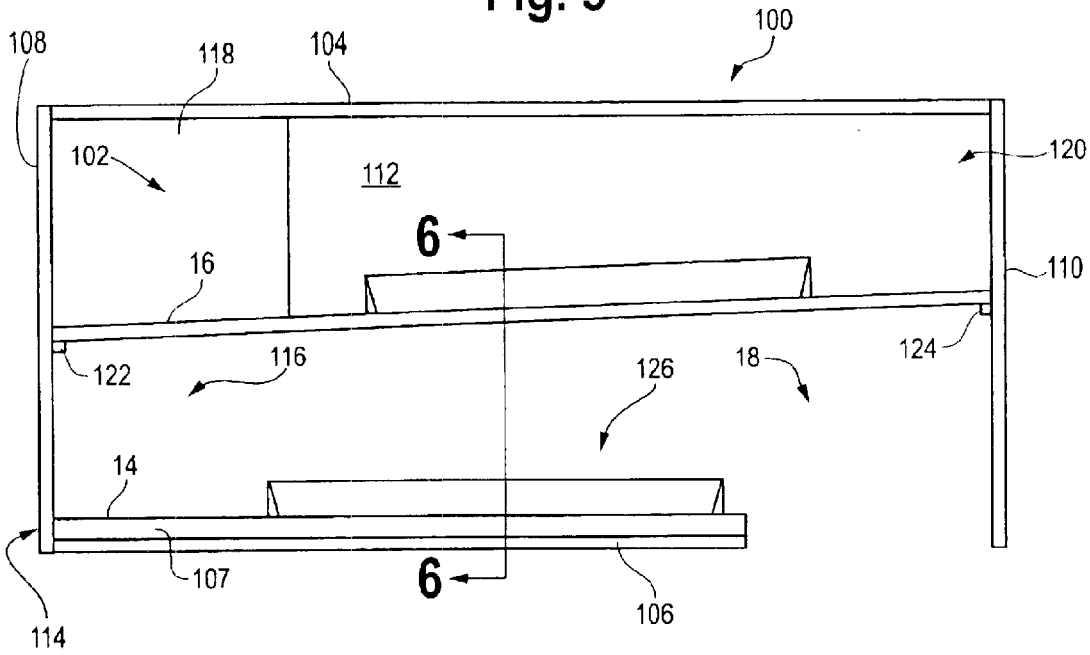
FIG. 5 is a front view of the storage insert of the system of FIG. 1.

FIG. 5 shows a dimensioned side view of the storage insert 11. As shown, the storage insert 11 may include a frame 100 for support of the shelves 14, 16, a set of bottle guides 102 (disposed on the shelves 14, 16 and a backwall 112) and a drain tray 126.

In use, storage insert 11 may include a bottle loading area 116 and a bottle unloading area 118. The bottle loading 116 may be an area that a bottled water delivery man places full bottles 20. As each full bottle 20 is inserted into the bottle loading area 116, the incline towards the installation area 18 causes the bottles 20 to roll towards the installation area 18.

Similarly, the bottle unloading area 118 may be a location from which the delivery man removes empty bottles. As each empty bottle 22 is removed from the cooler 12 by a bottled water user, the user may insert the empty bottle into an empty bottle return area 120. The incline towards the unloading area 118 causes the empty bottles 22 to roll towards the unloading area 118.

The frame 100 may include a top plate 104 and bottom plate 107, left side support 108, right side support 110 and back piece 112. The bottom plate 107 may be disposed between the shelf 14 and a user support surface 106. The bottom plate 107 may include one or more spacers 114 along the left side, inserted between the bottom plate 107 and the user support 106. The spacers 114 may be provided to allow for an appropriate incline or grade (e.g., 1–2%) between a bottle loading area 116 and the bottle installation area 18. The appropriate placement of a set of support brackets 122, 124 provides a similar grade for the empty bottle shelf 16.

The back piece 112 may be used to provide lateral support for the side pieces 108, 110. The back piece 112 may also provide vertical support for the central portion of the ramps 14, 16.

It should be noted that the loading shelf 14 is shorter than the empty bottle shelf 16. The shorter length of the loading shelf 14 provides an aperture that receives the water bottle accepting end of the water bottle installation system 24.

The bottle guides 102 (on the shelves 12, 14 and backwall 12) may include a first set of angled guides 128 (shown as part 126 in FIG. 5) and a second set of flat-shaped or triangular guides 130. The flat-shaped or triangular guides 130 may be disposed on a rear wall 112 of the insert 11.

The angled guides 128 may be provided along a discharge end of the bottles 20, 22. The angled guides 128 may be provided with an engagement side that contacts the bottle with an angle that is complementary to the angle on a shoulder of the discharge end of the bottle 20, 22.

The guides 128, 130 may be provided with a layer of low-friction material to allow the water bottles 20, 22 to freely roll towards a lower end of the inclined ramps 14, 16. Any appropriate material (e.g., Teflon, Delrin, etc.) may be used as the coating material.

The insert 11 may also include a drain tray 126. The drain tray 126 may be provided to catch and collect in leakage from defective bottles.

The inclines of the shelves 14, 16 offer a number of advantages. First, the incline towards the installation area 18 results in any remaining bottles 20 always being delivered to the installation area 18. The incline of the empty bottle shelf 16 away from the installation area 18 results in removal of the empty bottles 22 from the installation area 18.

The automatic delivery of full bottles 20 to the installation area 18 and removal of empty bottles 22 allows a water user to quickly and easily replace an empty bottle 22 with a full bottle 20 without leaving the bottle exchange area. For similar reasons, a water delivery man may also deliver full and remove empty bottles from a single servicing area. Further, the length of the shelves 14, 16 allows the installation area 18 to be located some distance from the servicing area. This has the added advantage that a bottle delivery man need not enter the area of water use. This has significant advantage where the installation area 18 is placed on one side of a wall in a secure area (e.g., a factory) and the servicing area is placed on a second side of the wall in an unsecured area (e.g., a loading dock).

Figure 7:
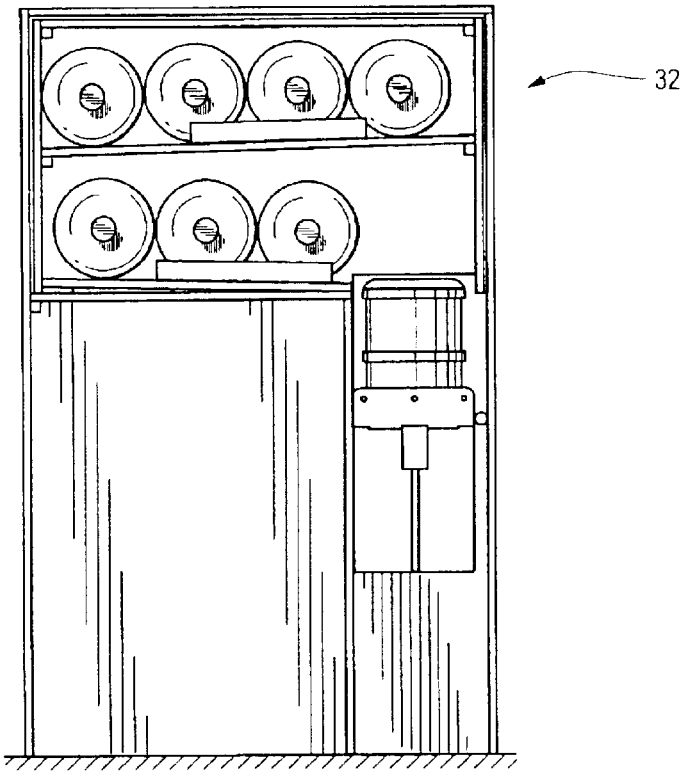
FIG. 7 depicts the insert and installation system of FIG. 1 within a user-supplied frame.
Figure 8:
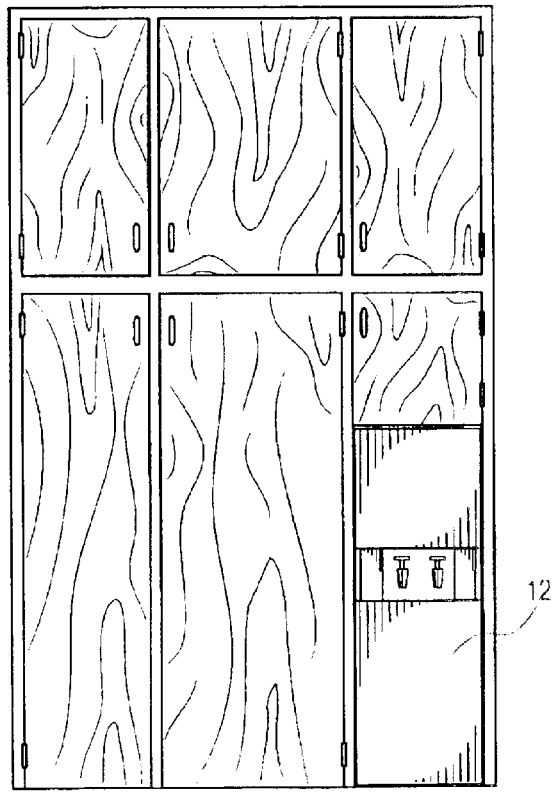
FIG. 8 depicts the user-supplied frame of FIG. 7 with cabinet doors.

FIG. 7 shows a frame 132 that may be used in conjunction with the insert 11 and installation system 24. FIG. 8 shows the frame 132 with a set of cabinet doors that provide an esthetically pleasing cover for the insert 11 and installation system 24.

Turning next to the installation system 24, FIGS. 9*a–b* show side and front views of the track assembly 36. As shown, a mounting plate 50 is provided for support of the installation system 24. The plate 50 may be secured to a wall or other supporting structure by an appropriate mounting technology (e.g., screws, lag bolts, etc.). An upper and lower mounting plate 68, 70 may be joined at right angles to the mounting plate 50 by another appropriate technology (e.g., welding, bolts, screws, etc.).

Connected between the mounting plates 68, 70 may be a pair of cylindrical rods 74, 76 and a locking column 78. The cylindrical rods 74, 76 may be connected between the mounting plates 68, 70 in a spaced apart relationship to accept a pair of linear bearings 40, 42 (see FIGS. 3 and 6) attached to the elevator assembly 34.

The locking column 78 may be a length of square tubing that is attached between the plates 68, 70 using a pair of offset plates 80, 82. The locking column 78 may be provided with a pair of apertures 60, 62 that are engaged by the elevator locking assembly 54. The offset plates 80, 82 may provide sufficient lateral offset to allow the elevator locking assembly 54 to engage apertures 60, 62 while still clearing the cradle assembly 32 when the cradle 32 is in its lowered position.

Also shown on the mounting plate 50 is an attachment clevis 72. The attachment clevis 72 may be used as a lower attachment point for the elevator cylinder 64.

FIG. 10 shows a simplified side view of the cradle 32 and elevator assembly 34. FIG. 3 shows a cut-away side view of the installation system 24 along section lines 3—3.

Figure 6:
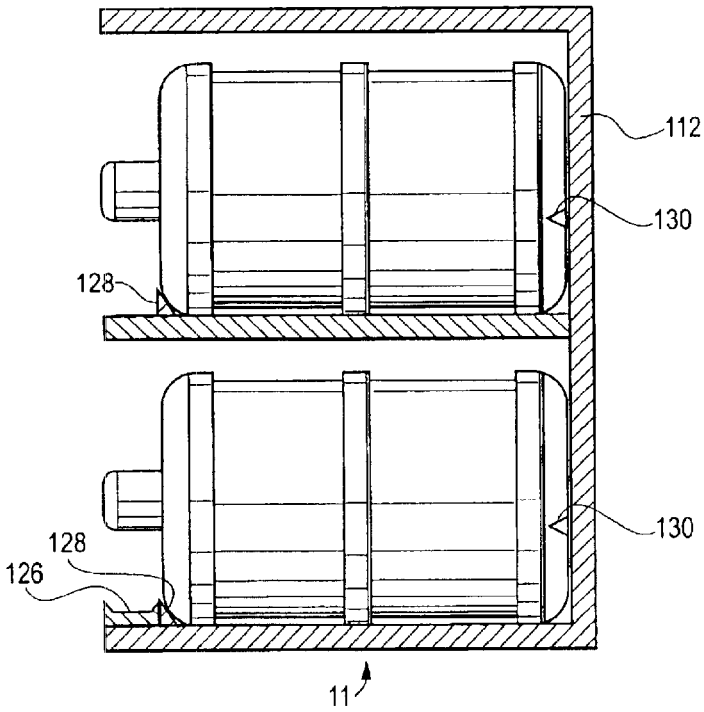
FIG. 6 is an end view of the storage insert of FIG. 5.

As shown in FIGS. 3 and 6, the elevator assembly 34 includes a support plate 80 with two sets of linear bearings 40, 42 attached. Each linear bearing may include top and bottom bosses and a center bearing tube. One linear bearing 42 is disposed on a first cylindrical rod 74 of the track assembly 36 and the second linear bearings 40 is disposed on the second cylindrical rod 76. The interaction of the linear bearings 40, 42 with the cylindrical rods 74, 76 of the track assembly 36 function to provide lateral stability in the rotation and descent of the elevator 34, cradle 32 and water bottle 20.

Centrally mounted on the inside surface of the support plate 80 is an attachment clevis 82. The attachment clevis 82 functions as a central attachment point for the rotation cylinder 66 and elevator cylinder 64.

FIG. 11 shows a simplified cut-away view along section lines 7—7 in FIG. 10. As shown in FIG. 11, the locking rod 58 of the elevator locking assembly 54 may be provided with a support tube 84 for lateral support of the locking rod 58. As shown, an L-shaped mounting bracket 86 may be used to secure the elevator locking assembly 54 to the mounting plate using a common set of bolts 88, 90 that are also used to secure the end boss of the linear bearing 42 to the support plate 80. The support tube 84, in turn, may be threaded into the bracket 86 and secured with a set screw 92.

The use of the water bottle installation system 24 results in the easy and convenient placement of a water bottle 20 into a water cooler 12 without undue effort or strain on the part of the water bottle installer. In fact, the loading of a water bottle 20 can be easily performed by a person (e.g., a woman, a child, disabled person, etc.) who would not otherwise be capable of lifting a water bottle.

In another embodiment of the invention the elevator locking assembly 54 (including the locking column 78) is replaced with an actuator assembly 100 (shown in phantom in FIG. 10) mounted to the cradle 32 and a slip-lock assembly 102 (shown in FIG. 12) that is mounted to the elevator assembly 34. A pair of horizontal slots 104, 106 are cut into the cylindrical rod 74. A peg 108 and relatively rigid flat spring 110 are secured to a lower boss 112 of the linear bearing 42. The peg 108 is biased against the rod 74 by the spring 110. As the slip-lock assembly 102 travels up and down the rod 74, the peg 108 is biased into the slots 104, 106 by the spring 110 (and engages the slots 104, 106 in the raised and lowered position). Once the peg 108 engages a slot 104, 106, the relatively rigid flat spring 110 locks the elevator assembly into that position.

To release the slip-lock 102, the peg 108 is provided with an extension (coming out of the page in FIG. 12 that extends laterally past the rod 74). A pin 116 on an end of the extension is positioned to allow engagement by the actuator assembly 100.

The actuator assembly 100 may include an actuator handle 118 (FIG. 10), and an actuator rod 120 that extends through apertures on opposing sides of the cradle 32. A flared pin receptacle 126 on a distal end of the actuator rod 120 engages the pin 116 on the slip-lock 102. A retainer pin 122 and return spring 124 bias the rod 120 into a retracted position to prevent the accidental activating of the slip-lock 102.

To release the slip-lock 102, a user simply pushes the handle 118 inwards. Activation of the handle 118 causes the pin receptacle 126 to engage the pin 116 and releases the peg 108 from the slot 104, 106. Release of the peg 108 from the slot 104, 106 allows the elevator 34 to move up or down as discussed above.

It should also be noted, that under the alternate embodiment, the placement of the release handles 46, 118 allows for foolproof operation. For example, when the bottle 20 is first loaded into the cradle 32, the cradle release handle 46 is directly in front of the user while the elevator release handle 118 is on top of and out of sight of the user. Once the bottle 20 has rotated into the vertical position, the cradle release handle 46 is behind (and partially obscured by) the bottle 20 and the elevator release handle 118 is now in front of the user.

Specific embodiments of methods and apparatus for installing a water bottle into a water cooler according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. An apparatus for loading water bottles into a water cooler, such apparatus comprising:

a water bottle loading system for automatically installing water bottles into the water cooler; and a water bottle storage insert with an inclined ramp adapted to laterally urge a plurality of water bottles towards a loading cradle of the automatic water bottle loading system under control of gravity.

2. The apparatus for loading water bottles as in claim 1 wherein the inclined ramp further comprises a lower shelf of the water bottle storage insert.

3. The apparatus for loading water bottles as in claim 2 wherein the lower shelf of the water bottle storage insert further comprises an aperture that receives a water bottle accepting end of the automatic water bottle loading system.

4. The apparatus for loading water bottles as in claim 3 wherein the inclined ramp further comprises a water bottle stop adjacent the aperture for retarding the movement of the water bottles along the inclined ramp.

5. The apparatus for loading water bottles as in claim 2 wherein the water bottle storage insert further comprises an upper shelf for supporting empty water bottles.

6. The apparatus for loading water bottles as in claim 5 wherein the upper shelf further comprises a water bottle guide along a front and rear surfaces of the upper shelf.

7. The apparatus for loading water bottles as in claim 6 wherein the front water bottle guide further comprises an inclined surface adapted to engage a shoulder, adjacent a neck of each water bottle of the plurality of water bottles.

8. The apparatus for loading water bottles as in claim 6 wherein the front and back water bottle guides further comprise a strip of low-friction material covering a region of engagement between the guides and the water bottles.

9. The apparatus for loading water bottles as in claim 5 wherein the water bottle storage insert further comprises a pair of opposing side walls that support opposing ends of the upper shelf.

10. The apparatus for loading water bottles as in claim 9 wherein the water bottle storage insert further comprises a pair of opposing side-walls that support opposing ends of the upper shelf.

11. The apparatus for loading water bottles as in claim 9 wherein the water bottle storage insert further comprises a back wall that laterally supports the opposing side-walls, the upper shelf and the gravity-fed ramp.

12. The apparatus for loading water bottles as in claim 5 wherein the upper shelf further comprises a grade that slopes in a direction that is opposite the gravity fed ramp to allow the empty water bottles to roll in a direction that is away from the water cooler.

13. The apparatus for loading water bottles as in claim 1 wherein the gravity fed ramp further comprises a drip channel to catch leakage from the water bottles.

14. The apparatus for loading water bottles as in claim 1 wherein the gravity fed ramp further comprises a water bottle guide along a front and rear surfaces of the gravity fed ramp.

15. The apparatus for loading water bottles as in claim 14 wherein the front water bottle guide further comprises an inclined surface adapted to engage a shoulder, adjacent a neck of each water bottle of the plurality of water bottles.

16. The apparatus for loading water bottles as in claim 14 wherein the front and back water bottle guides further comprise a strip of low-friction material covering a region of engagement between the guides and the water bottles.

17. An apparatus for loading water bottles into a water cooler, such apparatus comprising:

a water bottle loading system for automatically installing water bottles into the water cooler; and a water bottle storage insert disposed above the automatic water bottle loading system containing a plurality of water bottles said water bottle storage insert adapted to laterally supply water bottles to the automatic water bottle loading system along a gravity fed ramp disposed within the water bottle storage insert.

18. The apparatus for loading water bottles as in claim 17 wherein the gravity fed ramp further comprises a lower shelf of the water bottle storage insert.

19. The apparatus for loading water bottles as in claim 18 wherein the lower shelf of the water bottle storage insert further comprises an aperture that receives a water bottle accepting end of the automatic water bottle loading system.

20. The apparatus for loading water bottles as in claim 19 wherein the gravity fed ramp further comprises a water bottle stop adjacent the aperture for retarding the movement of the water bottles along the gravity fed ramp.

21. The apparatus for loading water bottles as in claim 18 wherein the water bottle storage insert further comprises an upper shelf for supporting empty water bottles.

22. The apparatus for loading water bottles as in claim 21 wherein the upper shelf further comprises a water bottle guide along a front and rear surfaces of the upper shelf.

23. The apparatus for loading water bottles as in claim 22 wherein the front water bottle guide further comprises an inclined surface adapted to engage a shoulder, adjacent a neck of each water bottle of the plurality of water bottles.

24. The apparatus for loading water bottles as in claim 23 wherein the front and back water bottle guides further comprise a strip of low-friction material covering a region of engagement between the guides and the water bottles.

25. The apparatus for loading water bottles as in claim 21 wherein the water bottle storage insert further comprises a pair of opposing side walls that support opposing ends of the upper shelf.

26. The apparatus for loading water bottles as in claim 25 wherein the water bottle storage insert further comprises a pair of opposing side-walls that support opposing ends of the upper shelf.

27. The apparatus for loading water bottles as in claim 25 wherein the water bottle storage insert further comprises a back wall that laterally supports the opposing side-walls, the upper shelf and the gravity-fed ramp.

28. The apparatus for loading water bottles as in claim 21 wherein the upper shelf further comprises a grade that slopes in a direction that is opposite the gravity fed ramp to allow the empty water bottles to roll in a direction that is away from the water cooler.

29. The apparatus for loading water bottles as in claim 21 wherein the gravity fed ramp further comprises a drip channel to catch leakage from the water bottles.

30. The apparatus for loading water bottles as in claim 17 wherein the gravity fed ramp further comprises a water bottle guide along a front and rear surfaces of the gravity fed ramp.

31. The apparatus for loading water bottles as in claim 30 wherein the front water bottle guide further comprises an inclined surface adapted to engage a shoulder, adjacent a neck of each water bottle of the plurality of water bottles.

32. The apparatus for loading water bottles as in claim 31 wherein the front and back water bottle guides further comprise a strip of low-friction material covering a region of engagement between the guides and the water bottles.

33. An apparatus for loading water bottles into a water cooler, such apparatus comprising:

a water cooler;

an water bottle loading system for automatically installing water bottles into the water cooler;

a water bottle storage insert disposed above the automatic water bottle loading system containing a plurality of water bottles said water bottle storage insert adapted to laterally supply water bottles to the automatic water bottle loading system along an inclined feed ramp disposed within the water bottle storage insert where said water bottles are urged down the inclined feed ramp towards the automatic water bottle loading system by gravity.

* * * * *